US007921793B2

(12) United States Patent
Bruland

(10) Patent No.: US 7,921,793 B2
(45) Date of Patent: Apr. 12, 2011

(54) AIRBORNE TUGBOAT FOR EMERGENCY AID FOR SEAGOING VESSELS

(76) Inventor: Reidar Holch Bruland, Fagerstrand (NO)

( * ) Notice: Subject to any disclaimer, the term of this patent is extended or adjusted under 35 U.S.C. 154(b) by 12 days.

(21) Appl. No.: 11/911,535

(22) PCT Filed: Apr. 12, 2006

(86) PCT No.: PCT/NO2006/000138

§ 371 (c)(1),
(2), (4) Date: Jan. 25, 2008

(87) PCT Pub. No.: WO2006/112722

PCT Pub. Date: Oct. 26, 2006

(65) Prior Publication Data

US 2008/0190345 A1 Aug. 14, 2008

(30) Foreign Application Priority Data

Apr. 19, 2005 (NO) ..... 20051915

(51) Int. Cl.
*B63B 35/68* (2006.01)

(52) U.S. Cl. ..... 114/253; 114/345

(58) Field of Classification Search ..... 114/242, 114/253, 345, 246, 248, 249, 251, 254
See application file for complete search history.

(56) References Cited

U.S. PATENT DOCUMENTS

| | | | | | |
|---|---|---|---|---|---|
| 2,698,447 | A * | 1/1955 | Potts et al. | ..... | 114/345 |
| 2,924,192 | A * | 2/1960 | Salvage | ..... | 114/68 |
| 3,805,729 | A * | 4/1974 | Golay et al. | ..... | 114/246 |
| 4,021,873 | A * | 5/1977 | Francois | ..... | 114/345 |
| 4,231,131 | A * | 11/1980 | Young | ..... | 114/345 |
| 4,305,710 | A * | 12/1981 | Schneider | ..... | 440/75 |
| 4,545,319 | A * | 10/1985 | Ferronniere et al. | ..... | 114/345 |
| 4,819,576 | A | 4/1989 | Shaw | | |
| 5,094,638 | A | 3/1992 | Kobayashi | | |
| 6,260,500 | B1 | 7/2001 | Coakley | | |
| 6,416,369 | B1 | 7/2002 | Coakley | | |
| 2005/0172882 | A1 * | 8/2005 | Yung | ..... | 114/345 |
| 2005/0268833 | A1 * | 12/2005 | Conrad | ..... | 114/55.5 |

* cited by examiner

*Primary Examiner* — Lars A Olson
(74) *Attorney, Agent, or Firm* — Christian D. Abel

(57) ABSTRACT

An airborne tugboat with three hulls (4): an underbody (4), surface body (5) and inflatable body (6). When stationed on shore the inflatable body is not activated, but is folded up against the surface body. Gas turbine (1) drives the propeller (3) via the reduction gear (2). The rotatable ring (8) round the propeller makes the airborne tugboat maneuverable, and when the disabled ship is towed, it will be able to influence towing direction without the risk of the airborne tugboat heeling over. By its design the airborne tugboat should be regarded as a slow-moving towing boat where the speed is low but the power in the towing direction is great. The design is characterised by low weight in all machinery and equipment. The amount of fuel restricts the operating time, but the helicopter and airborne tugboat, for example, use the same fuel, thus providing the advantage that the helicopter can refuel the airborne tugboat before it returns to base.

3 Claims, 3 Drawing Sheets

AIRBORNE TUGBOAT FOR EMERGENCY AID FOR SEAGOING VESSELS

The invention relates to an airborne tugboat for emergency aid for seagoing vessels along stretches of coast far removed from conventional tugboats.

The low weight of the airborne tugboat makes it suitable for transport by helicopter out to the disabled ship where it is launched after attachment of the towline, with the object of coming to the rescue of the damaged ship and preventing it from running aground in an uncontrolled manner with the risk of pollution of the environment. It has repeatedly been shown that ships with propulsion machinery failure are carried by wind and current towards land, causing pollution, both here on our own coast and in other waters. These accidents could have largely been avoided if there had been better tugboat coverage. In practice, it will be a huge and costly challenge to provide coverage of this kind on long stretches of coast. A conventional tugboat cannot reach a speed of more than 15 to 18 knots, approximately 30 kilometers an hour, while the airborne tugboat can be transported by helicopter. A Sea King type helicopter, for example, has a top speed of 270 km an hour and a cruising speed of 200 km an hour, and can transport an airborne tugboat quickly over long distances.

From the prior art, mention may be made of U.S. Pat. No. 6,269,763 and U.S. Pat. No. 6,260,500. The vessel disclosed in U.S. Pat. No. 6,260,500, however, is equipped with a rigid hull which makes it impractical for helicopter transport, in addition to which the towline is not directly attached in the propeller's pulling direction. The vessel disclosed in U.S. Pat. No. 6,269,763, on the other hand, is an underwater vehicle, which makes it difficult for the crew to control the towing operation. In the case of this known device too, the towline is not directly attached in the propeller's pulling direction. Due, amongst other things, to the way in which the towline is attached to these known devices, they will not achieve sufficient pulling power or stability. There is also a great risk of the towline coming into contact with the propeller in a heavy sea.

The airborne tugboat according to the invention is designed so as to have little mass but great pushing/pulling power and this is achieved according to the invention by its design. The invention's characterising features are indicated in the following claims.

The airborne tugboat according to the invention is described below with reference to the attached drawings, in which.

Figure 1:
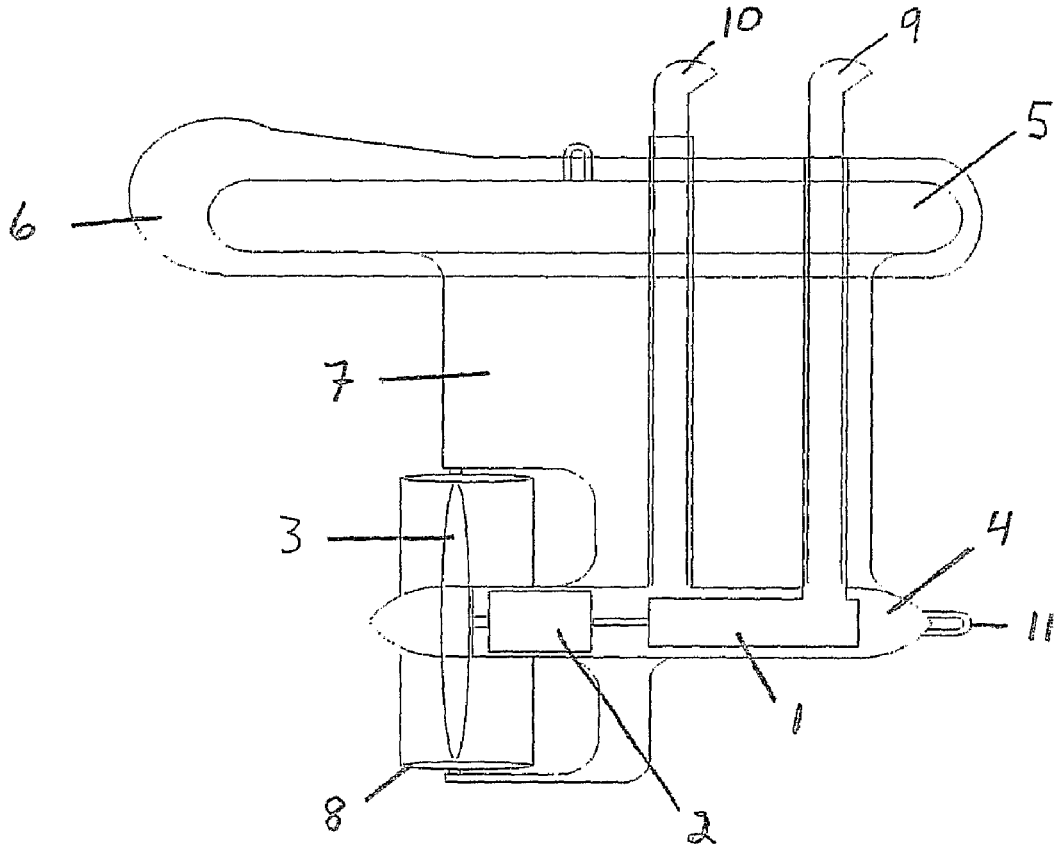
FIGS. 1 and 2 are side views of the vessel
Figure 4:
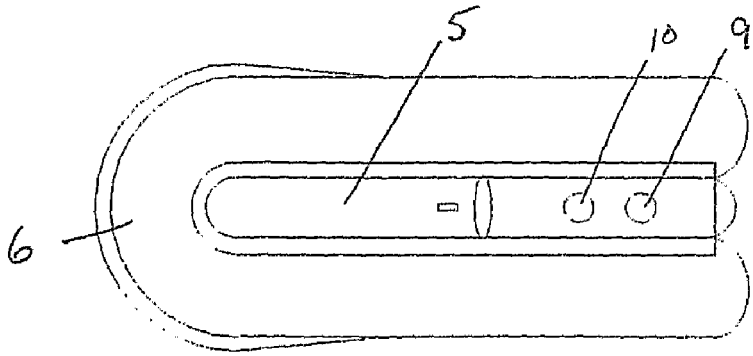
FIG. 4 is a view from above.
Figure 3:
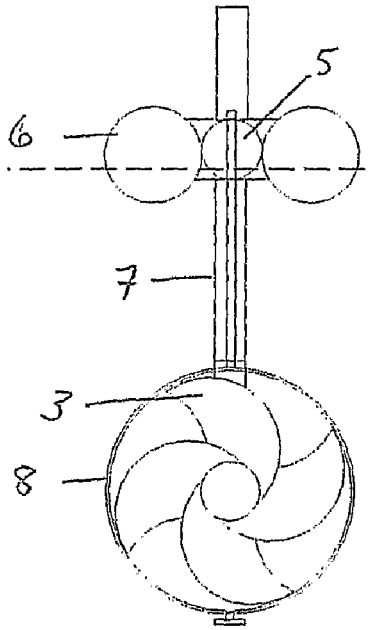
FIG. 3 is a view from behind.
Figure 2:
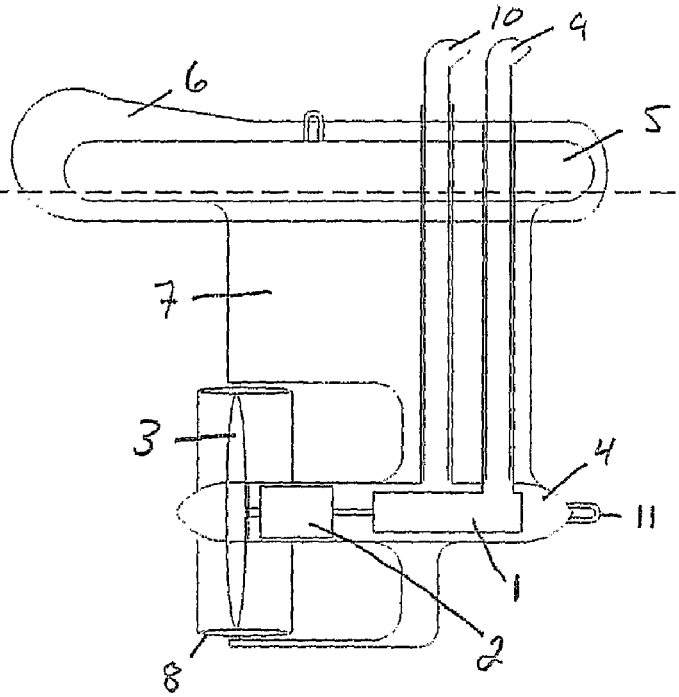

As illustrated in the figures, the airborne tugboat comprises a tubular underbody 4 on which are mounted a drive motor, propulsion system and steering system. According to a preferred embodiment the drive motor comprises a gas turbine 1, for example a Pratt & Whitney turbine of 1500 shp, weighing only 136 kg.

The propulsion system further comprises a gearbox and thrust bearing 2 in connection with the turbine, and a propeller 3 mounted in a rotatable thrust ring 8 for manoeuvring the vessel. The propeller is preferably made of a synthetic material for low weight. The underbody 4 is connected to a surface body 5 by an intermediate body 7 in the form of a fin containing, amongst other things, a telescopic exhaust pipe 9 and air intake 10.

The surface body 5 also has an inflatable body 6 which is activated during launching. Since it is folded up during air transport, air resistance is reduced during transport. Both surface body, underbody and the connection between them also contain fuel tanks.

The invention is based on a vessel with low weight and great pushing or pulling power. By employing a gas turbine connected to a gearbox which in turn drives a propeller, low weight is obtained compared to conventional ship's propulsion. The propeller has a large diameter and low pitch, thereby achieving great pulling power at low speeds; for reasons of weight the propeller should be made of synthetic material. The airborne tugboat maintains its great pulling power due to the small pitch of the propeller and its low speed.

The propeller is mounted in a thrust ring on the forward part of the underbody. A tow fastening in the form of a hook 11 is provided at the aft part of the underbody in order to have the towline directly attached in the propeller's pulling direction.

The drive turbine and reduction gear are derived from existing power transmission systems for helicopters with low weight and low rotor speed, and with known technology for thrust bearings in transmission shafts.

The tugboat is equipped with a control system, which may be radio or otherwise remotely controlled, via cables, or manually by a person on board.

Figure 5:
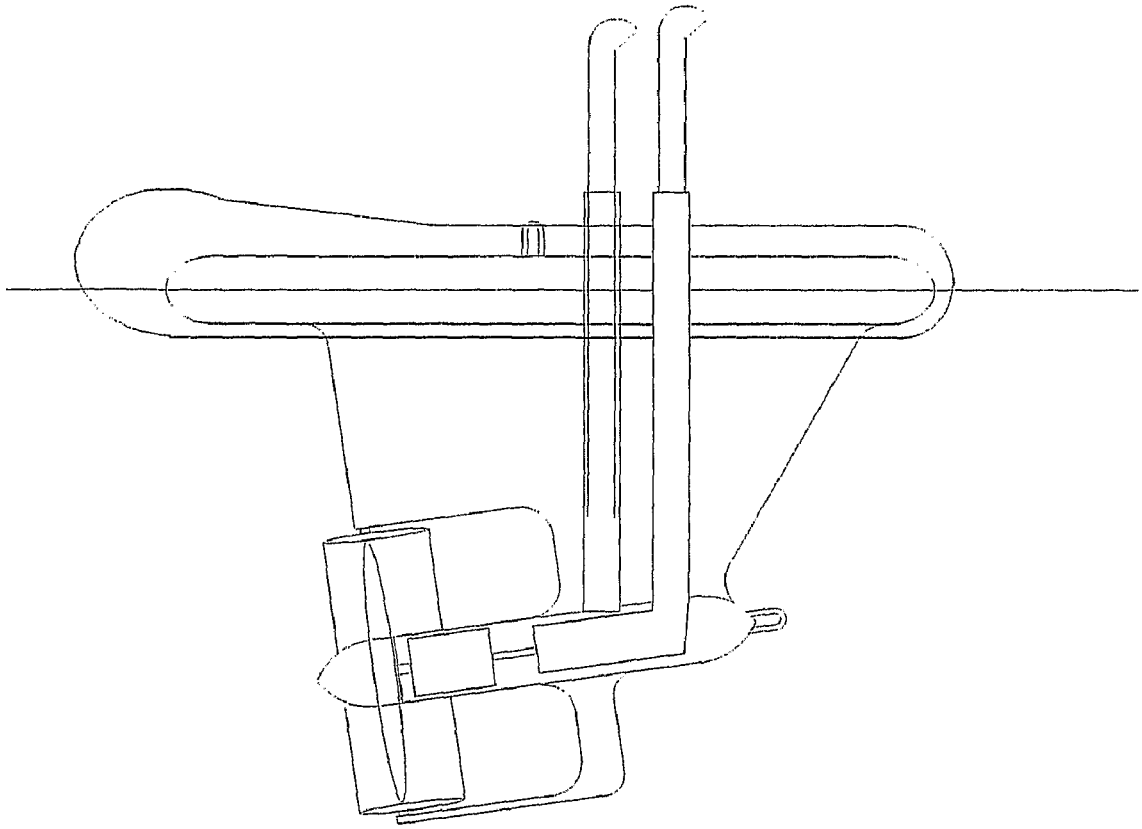
FIG. 5 illustrates an alternative embodiment of the vessel.

Several versions of the airborne tugboat may be provided, where it is adapted to the area in which it has to operate. An alternative embodiment is depicted in FIG. 5, where the propeller is angled in order to change the drive direction. It is also possible to provide the vessel with several body/propulsion systems, where the towline is attached between them so that the towline is arranged directly in the propellers' resultant force direction.

The invention claimed is:

1. A tugboat surface vessel comprising a buoyant, surface-floating body, an intermediate body and an underbody provided with a propulsion system including one or more engines and one or more propellers, said tugboat vessel being arranged to receive a towline attached between a disabled ship and the tugboat whereby the towline is fastened to the underbody in the propeller's/propellers' direct or resultant force direction, said propeller being mounted in a rotatable thrust ring and the towline being attached to a hook arranged in a straight line from the propeller's pulling direction, wherein said buoyant surface floating body further comprises an inflatable buoyancy member, the inflation of said buoyancy member being automatically activated upon contact with water, said vessel being further adapted for transport in an aircraft is its uninflated state, such that the vessel may be launched into the water, whereupon the inflatable buoyancy member will inflate.

2. A tugboat surface vessel comprising a buoyant, surface-floating body, a fin-shaped intermediate body and a tubular underbody with a propulsion system including one or more engines and one or more propellers, said tugboat vessel being arranged to receive a towline attached between a disabled ship and the tugboat whereby the towline is fastened to the underbody in the propeller's/propellers' direct or resultant force direction, wherein said buoyant surface floating body further comprises an inflatable buoyancy member, the inflation of said buoyancy member being automatically activated upon contact with water, said vessel being further adapted for transport in an aircraft is its uninflated state, such that the vessel may be launched into the water, whereupon the inflatable buoyancy member will inflate.

3. A tugboat surface vessel comprising a buoyant, surface-floating body, an intermediate body and an underbody provided with a propulsion system including one or more engines and one or more propellers, said tugboat vessel being arranged to receive a towline attached between a disabled ship and the tugboat whereby the towline is fastened to the underbody in the propeller's/propellers' direct or resultant force direction, wherein said buoyant surface floating body further comprises an inflatable buoyancy member, the inflation of said buoyancy member being automatically activated upon contact with water, said vessel being further adapted for transport in an aircraft is its uninflated state, such that the vessel may be launched into the water, whereupon the inflatable buoyancy member will inflate, said vessel further comprising an elongated exhaust pipe and an elongated air intake pipe arranged between the engine and the water surface wherein the air intake pipe and exhaust pipe are telescopic and arranged for storage in the intermediate body of the tugboat vessel prior to launching.

* * * * *